US008699924B2

(12) United States Patent
Hatano

(10) Patent No.: US 8,699,924 B2
(45) Date of Patent: Apr. 15, 2014

(54) DEVELOPING APPARATUS AND IMAGE FORMING APPARATUS HAVING A MAGNETIC FIELD GENERATING MEMBER

(75) Inventor: Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 13/275,689

(22) Filed: Oct. 18, 2011

(65) Prior Publication Data

US 2012/0099905 A1 Apr. 26, 2012

(30) Foreign Application Priority Data

Oct. 25, 2010 (JP) ..... 2010-238688

(51) Int. Cl.
*G03G 15/09* (2006.01)

(52) U.S. Cl.
USPC ..... 399/269

(58) Field of Classification Search
USPC ..... 399/269, 279, 285
See application file for complete search history.

(56) References Cited

U.S. PATENT DOCUMENTS

| | | | | |
|---|---|---|---|---|
| 2002/0054773 | A1 * | 5/2002 | Shirai | 399/269 |
| 2007/0053725 | A1 * | 3/2007 | Sakamaki et al. | 399/269 |
| 2009/0087230 | A1 | 4/2009 | Hatano | |
| 2009/0123194 | A1 * | 5/2009 | Hatano | 399/285 |

FOREIGN PATENT DOCUMENTS

| | | |
|---|---|---|
| JP | 03-054956UA | 5/1991 |
| JP | 11-109748 | 4/1999 |
| JP | 11-109748 A | 4/1999 |
| JP | 2002-062731 A | 2/2002 |
| JP | 2007-240619 | 9/2007 |
| JP | 2009-116261 | 5/2009 |

* cited by examiner

*Primary Examiner* — G. M. Hyder
(74) *Attorney, Agent, or Firm* — Canon USA Inc IP Division

(57) ABSTRACT

A developing apparatus in which one sleeve is swingable includes a first magnetic field generating member inside a first developer bearing member, a second magnetic field generating member inside a second developer bearing member, and a positioning unit configured to perform positioning of a swinging connecting member in the peripheral direction or to perform positioning of the swinging connecting member in the peripheral direction through connection thereto.

4 Claims, 11 Drawing Sheets

DEVELOPING APPARATUS AND IMAGE FORMING APPARATUS HAVING A MAGNETIC FIELD GENERATING MEMBER

BACKGROUND OF THE INVENTION

1. Field of the Invention

An aspect of the present invention relates to a developing apparatus to be used in an image forming apparatus employing an electrophotographic system, such as a copying machine, a multifunction peripheral, a printer, or a facsimile machine, and to an image forming apparatus employing the developing apparatus.

2. Description of the Related Art

In a conventional image forming apparatus employing an electrophotographic system, the surface of an image bearing member is uniformly charged, and then image exposure is performed by using, for example, a semiconductor laser or a light-emitting diode (LED). An electrostatic latent image is formed on the image bearing member, and, then, this electrostatic latent image is turned into a toner image by a developing apparatus before transferring it onto a transfer material. As is known in the art, thereafter, the toner image is fixed to the transfer material by a fixing apparatus before outputting the transfer material.

In recent years, there has been an increasing demand for an improvement of image forming apparatuses in terms of speed and image quality. As a developing apparatus for use in such an image forming apparatus capable of high speed outputting, there is an image forming apparatus which is equipped with a plurality of developer carrying members carrying developer.

Apart from this, in order to achieve a reduction in the number of components, a known developing apparatus has the developer carrying members opposing each other in close proximity, with one developer carrying member regulating the developer carried by the other developer carrying member at the opposing position.

Further, in connection with the above-described developing apparatus, there has been proposed a developing apparatus including a first developer carrying member serving as a swinging center, a second developer carrying member swingable around the first developer carrying member while maintaining a predetermined gap, and four abutment rollers respectively provided at both ends of the first and second developer carrying members and consisting of circular members used to guarantee a gap between an image bearing member and the second developer carrying member, whereby, as compared with a construction utilizing no swinging movement, it is possible to secure the requisite gap between the image bearing member and the second developer carrying member in a more stable manner.

However, when such a swinging construction is adopted, it is rather difficult to fix a second magnetic field generating member, which is provided in the second developer carrying member that is swingable, to a container.

To deal with the above problem, there has been proposed a developing apparatus of the type which includes a first developer carrying member serving as a swinging center and a second developer carrying member swingable around the first developer carrying member, wherein a second magnetic field generating member is set in position with respect to a connecting member connecting the first developer carrying member and the second developer carrying member to each other, whereby it is possible to perform positioning of magnetic poles without hindering the swinging movement of the second developer carrying member as discussed in Japanese Patent Application Laid-Open No. 2009-116261.

However, when such a developing apparatus, in which one developer carrying member is swingable, is attached to the body of an image forming apparatus, variation occurs in component precision in terms of the angle by which the second developer carrying member swings.

Since the first magnetic field generating member is set in position with respect to a developing container, and the second magnetic field generating member is set in position with respect to the swinging connecting member, such variation in the angle by which the second developer carrying member swings results in variation in the relative positions (phase) in the peripheral direction of the (the peripheral direction of the first and second developer carrying members) first and second magnetic field generating members. That is because, when the connecting member swings, the second magnetic field generating member swings integrally therewith, whereas the first magnetic field generating member, which is fixed to the developing container, does not swing.

In particular, in the developing apparatus of the type in which one of the first and second developer carrying members regulates the developer carried by the other in the gap (hereinafter referred to as the SS-gap) across which the first and the second developer carrying members are opposed to each other, the phase of the opposing magnetic poles (hereinafter referred to as the SS-poles) of the first and second magnetic field generating members is of importance.

Thus, due to deviation in the phase of the SS-poles caused by the above-mentioned variation in the swinging angle of the second developer carrying member, there is a possibility of a defective coating of the surface of the developer carrying members, which may cause an image defect such as unevenness in density.

SUMMARY OF THE INVENTION

An aspect of the present invention is directed to a developing apparatus in which the correct phase of the SS-poles of the magnetic field generating members opposed to each other is secured irrespective of variation in the swinging angle of the second developer carrying member due to variation in component precision.

According to an aspect of the present invention, a developing apparatus includes a developing container accommodating a magnetic developer, a first developer carrying member rotatably fixed to the developing container and configured to carry and convey the magnetic developer, a second developer carrying member provided so as to be swingable around the first developer carrying member and configured to carry and convey the magnetic developer, which is regulated at a position where the second developer carrying member is opposite the first developer carrying member, a first magnetic field generating member provided inside the first developer carrying member, the first magnetic field generating member having a plurality of magnetic poles including at least a first magnetic pole provided at a position opposite the second developer carrying member, a second magnetic field generating member provided inside the second developer carrying member, the second magnetic field generating member having a plurality of magnetic poles including at least a second magnetic pole of a different polarity from that of the first magnetic pole at a position opposite the first magnetic pole, a connecting member connecting the first and second developer carrying members and configured to swing together with the second developer carrying member, an urging member configured to urge the second developer carrying member toward an image bearing member, and a positioning unit configured to perform positioning on the connecting member in the peripheral direction of the first and second magnetic field generating members.

According to another aspect of the present invention, a developing apparatus includes a developing container accommodating a magnetic developer, a first developer carrying member rotatably fixed to the developing container and configured to carry and convey the magnetic developer, a second developer carrying member provided so as to be swingable around the first developer carrying member and configured to carry and convey the magnetic developer, which is regulated by a portion where the second developer carrying member is opposite the first developer carrying member, a first magnetic field generating member provided inside the first developer carrying member, the first magnetic field generating member having a plurality of magnetic poles including at least a first magnetic pole provided at a position opposite the second developer carrying member, a second magnetic field generating member provided inside the second developer carrying member, the second magnetic field generating member having a plurality of magnetic poles including at least a second magnetic pole of a different polarity from that of the first magnetic pole at a position opposite the first magnetic pole, an urging member configured to urge the second developer carrying member toward an image bearing member, and a positioning unit configured to connect the first and second magnetic field generating members to each other and to perform mutual positioning in the peripheral direction on the first and second magnetic field generating members.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
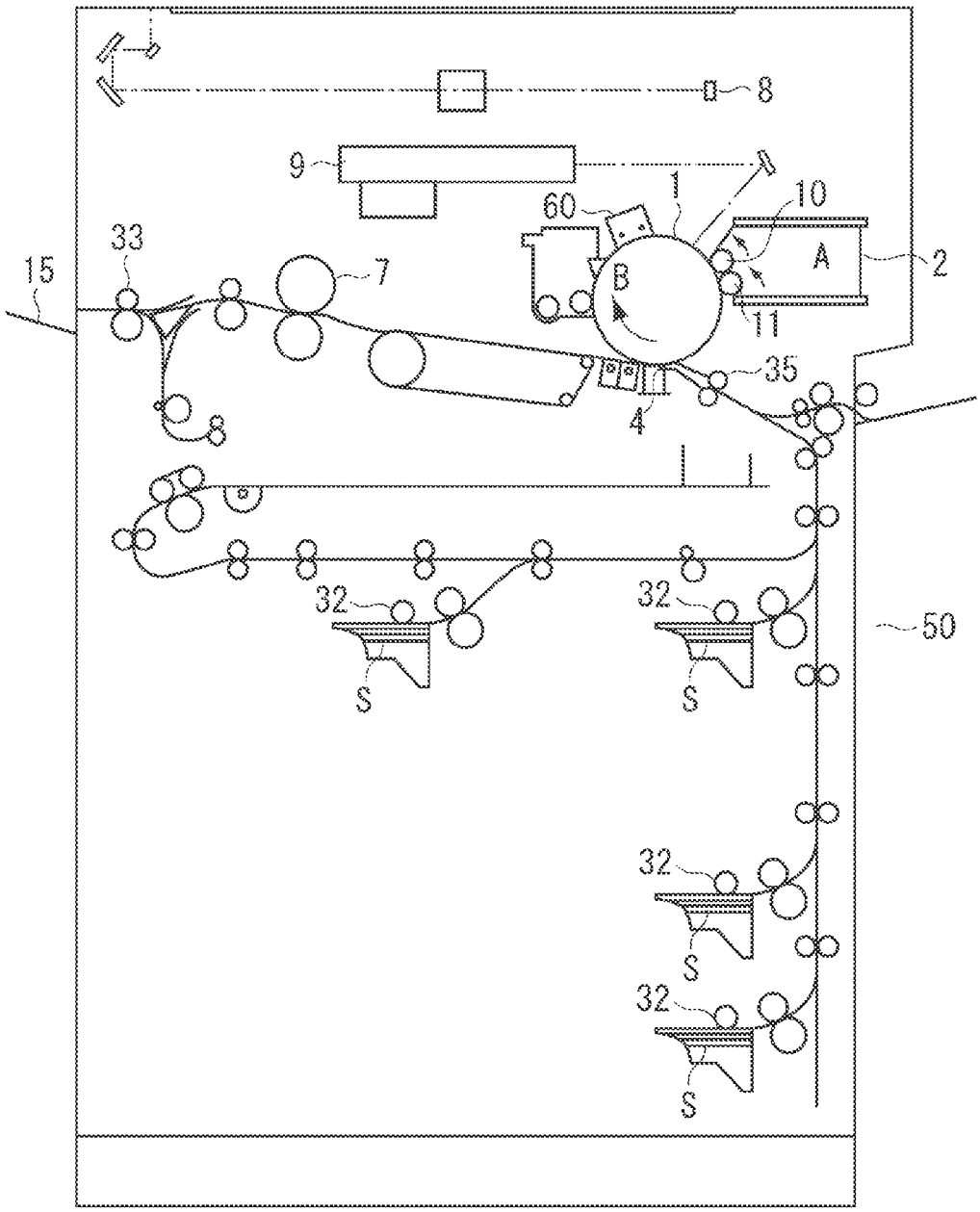
FIG. 1 is a sectional view schematically illustrating a construction of an image forming apparatus according to an exemplary embodiment of the present invention.

FIG. 1 is a sectional view schematically illustrating a construction of an image forming apparatus according to an exemplary embodiment of the present invention. While, in the present exemplary embodiment illustrated below, the image forming apparatus is a copying machine, this should not be construed restrictively, and it may also be a printer or a facsimile apparatus.

As illustrated in FIG. 1, in an image forming apparatus 50, an image of a document is read by an image reading unit 8, and, in accordance with a command from a controller (not illustrated) based on the image data read, exposure is performed on the surface of a photosensitive drum 1 serving as an image bearing member from an image writing unit 9, whereby an electrostatic latent image is formed.

Prior to the exposure, the surface of the photosensitive drum 1 is uniformly charged to a predetermined potential by a charger 60. A laser beam is applied to the photosensitive drum 1 thus uniformly charged from an image writing unit 9, whereby an electrostatic latent image is formed on the photosensitive drum 1. The electrostatic latent image formed on the photosensitive drum 1 is developed by the developing apparatus 2 to be turned into a toner image, which is conveyed to a portion opposing a transfer apparatus 4 through rotation of the photosensitive drum 1.

On the other hand, a sheet S serving as a recording medium is fed from a sheet cassette by a pick-up roller 32. The sheet S is conveyed to a position in front of a registration roller pair 35, and conveyed to a portion where the photosensitive drum 1 and the transfer apparatus 4 are opposed to each other by the registration roller pair 35 in synchronism with the toner image on the photosensitive drum. Then, the toner image on the photosensitive drum 1 is transferred to the sheet S by the transfer apparatus 4.

Then, the sheet S is conveyed, and the toner image on the sheet S is turned into a fixed image through heating and pressing by a fixing roller pair 7, and then, the sheet S is stacked on a tray 15 outside the body of the image forming apparatus by a discharge roller 33, whereby a series of image formation processes are completed.

In the following, the developing apparatus 2 will be further described. In this example described below, there is adopted a mono-component development method using magnetic toner as the magnetic developer. However, the present invention is not limited to the mono-component development method but also allows adoption of a dual-component development method using a magnetic carrier and a non-magnetic toner. In the mono-component development method, the term magnetic developer means the magnetic toner, and, in the dual-component development method, it means the non-magnetic toner and the magnetic carrier.

The developing apparatus 2 has a developing container 3, which contains magnetic toner. Further, at positions opposing the photosensitive drum 1, the developing apparatus 2 is equipped with two rotatable cylindrical developing sleeves such as a first developing sleeve 10 and a second developing sleeve 11, which respectively constitute a first developer carrying member and a second developer carrying member.

The first and second developing sleeves 10 and 11 rotate in the same direction (the direction of the arrows A), carrying and conveying the magnetic toner in the developing container. In development regions where the photosensitive drum 1 and the developing sleeves 10 and 11 are opposed to each other, the electrostatic latent image on the photosensitive drum is developed.

In this way, the first and second developing sleeves 10 and 11 have their respective development regions, which means development is performed twice on the electrostatic latent image formed on the photosensitive drum. This helps to enlarge the development region as compared with the case where only one developing sleeve is used, so that it is possible to keep up with an increase in the image forming speed (an increase in printing speed).

On the other hand, the photosensitive drum 1 rotates in the direction of the arrow B, and the electrostatic latent image formed on the photosensitive drum 1 is first developed in the development region of the first developing sleeve 10, which is on the upstream side in the rotating direction of the photosensitive drum. Then, development is performed in the development region of the second developing sleeve 11, which is on the downstream side in the rotating direction of the photosensitive drum.

The developing process in each development region is an electrostatic latent image developing process based on a well-known electrostatic latent image technique, and in the present exemplary embodiment, the magnetic toner on the developing sleeve is caused to jump onto the photosensitive drum for development, that is, a so-called jumping development is performed.

However, this should not be construed restrictively, and it is also possible to adopt a so-called magnetic brush development method, in which development is performed by bringing the magnetic toner on the developing sleeve into contact with the photosensitive drum. Usually, at the time of development, a developing bias, for example, in which AC voltage and DC voltage are superimposed, is applied to each of the developing sleeves 10 and 11, as the developing bias.

Figure 2:
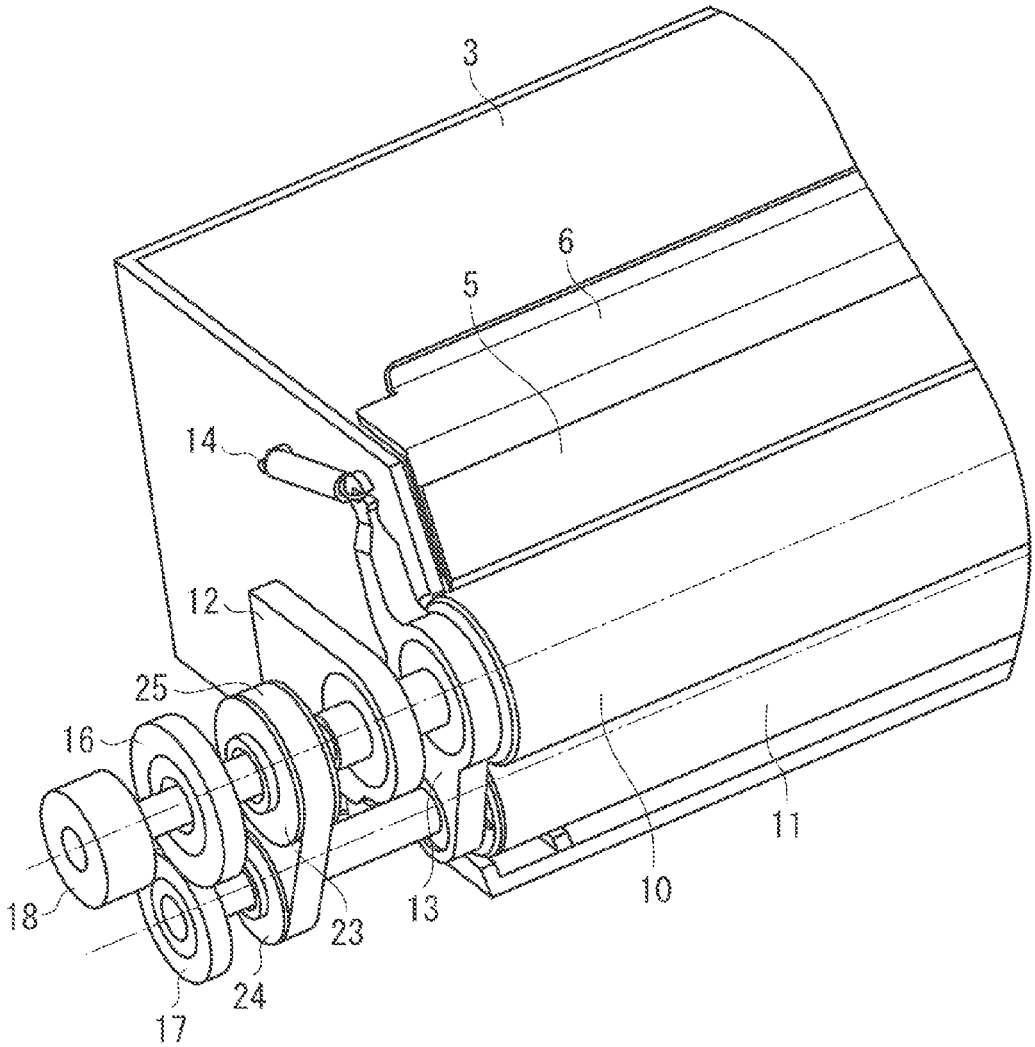
FIG. 2 is a perspective view illustrating a construction of a developing drive unit side end portion of a developing apparatus according to an exemplary embodiment.

Next, the construction of the developing apparatus according to the present exemplary embodiment will be described in detail. FIG. 2 is a perspective view illustrating the construction of the developing drive unit side end portion of the developing apparatus.

Above the first developing sleeve 10, there are provided a holding member 6 fixed to the developing container 3 and a blade 5 held by the holding member 6. The blade 5 is provided so as to maintain a gap between itself and the first developing sleeve 10, regulating the magnetic toner on the first developing sleeve to form it into a thin layer of a uniform thickness.

At a longitudinal end portion, the first developing sleeve 10 is fit-engaged with a bearing holder 12 having, in a fit-engagement hole, a bearing for rotatably supporting a rotation shaft, and is set in position with respect to the developing container 3 together with the bearing holder 12.

On the other hand, the second developing sleeve 11 is rotatably supported through fit-engagement with a fit-engagement hole of a swinging holder 13, which is a swinging member having, in a fit-engagement hole, a bearing for rotatably supporting a rotation shaft. The swinging holder 13 is also fit-engaged with the first developing sleeve 10, connecting the first and second developing sleeves to each other. As a result, the second developing sleeve 11 is swingable around the axis of the first developing sleeve 10.

In the developing apparatus 2, it is necessary to secure high precision for three gaps, a gap between the first developing sleeve 10 and the photosensitive drum (hereinafter referred to as the first SD gap), a gap between the second developing sleeve 11 and the photosensitive drum (hereinafter referred to as the second SD gap), and a gap between the first developing sleeve 10 and the second developing sleeve 11 (hereinafter referred to as the SS gap). This is because, the SD gaps influence the development property, and the SS gap influences the toner coat on the second developing sleeve.

In the developing apparatus according to the present exemplary embodiment, the first and second developing sleeves carry and convey the magnetic toner independently without effecting any delivery of toner therebetween. On the other hand, the magnetic toner on the second developing sleeve is regulated by the first developing sleeve in the gap between the sleeves.

As a result, the second developing sleeve, on which the magnetic toner is uniformly regulated, requires no blade. However, the SS gap also greatly influences the toner coat on the second developing sleeve, so that it is necessary to secure high precision for the SS gap.

Coaxially with the first developing sleeve 10 and at both longitudinal end portions thereof, there are provided abutment rollers 16, which are gap securing members securing the gap between the first developing sleeve 10 and the photosensitive drum 1. Similarly, abutment rollers 17 are provided coaxially with the second developing sleeve 11 and at both longitudinal end portions thereof. These abutment rollers are held in contact with the peripheral surface of the photosensitive drum 1, which constitutes the abutted portion, whereby the first and second SD gaps are secured.

The precision for the SS gap is secured by the precision in the distance between the centers of the two fit-engagement holes of the swinging holders 13 described above. Thus, it is possible to keep the SS gap constant irrespective of the swinging position of the swinging holder 13. Also at the end portion longitudinally on the side opposite to the developing drive unit side as illustrated in FIG. 2, which has a rotational drive input gear, there are provided the bearing holder 12, the swinging holder 18, and the abutment rollers 16 and 17 in the same arrangement.

The rotational drive input gear 18 receives drive from an input gear (not illustrated) on the image forming apparatus body side, and transmits rotational drive to the first developing sleeve 10. The rotational drive of the first developing sleeve 10 is transmitted to the second developing sleeve 11 via a timing belt 25 suspended between pulleys 23 and 24 provided coaxially with the first and second developing sleeves 10 and 11.

Figure 3:
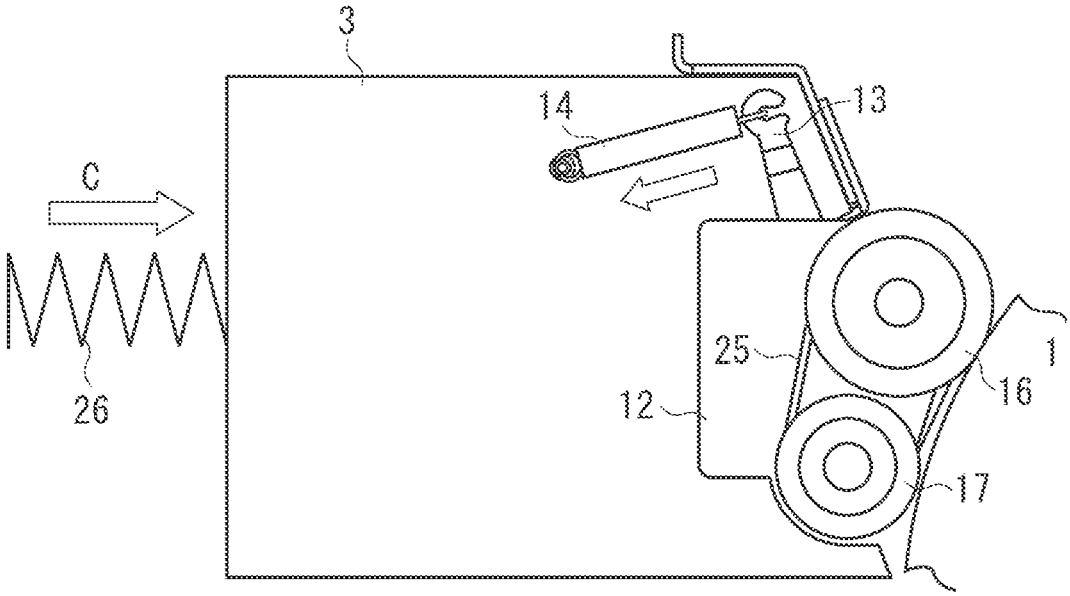
FIG. 3 is a diagram illustrating a longitudinal end portion on the developing drive unit side when the developing apparatus 2 is attached to the body of the image forming apparatus.

FIG. 3 is a diagram illustrating the developing drive unit side longitudinal end portion of the developing apparatus 2 when it is attached to the image forming apparatus body. In the following, positioning of the first and second developing sleeves at the time of attachment of the developing apparatus 2 will be illustrated.

As illustrated in FIG. 3, the image forming apparatus body is provided with a first pressurization spring 26 serving as an urging member, which urges the developing container 3 toward the photosensitive drum (in the direction of the arrow C). As a result, the first developing sleeve fixed to the developing container 3 is also urged toward the photosensitive drum, with the abutment roller 16 being brought into contact with the photosensitive drum 1. Thus, the first SD gap is secured.

On the other hand, the swinging holder 13 is provided with a second pressurization spring 14 serving as an urging member, urging the second developing sleeve 11 toward the photosensitive drum using the first developing sleeve as the swinging center, via the swinging holder 13.

The first developing sleeve 10 is set in position with respect to the developing container 3 by virtue of the bearing holder 12. Thus, when the second pressurization spring 14 serving as the urging member urges the swinging holder 13 in the direction of the arrow, the swinging holder 13 is urged so as to swing around the first developing sleeve.

As a result, the second developing sleeve 11 is urged toward the photosensitive drum to swing around the first developing sleeve. The developing container 3 has a stopper (not illustrated), which causes the swinging holder 13 to swing within a predetermined angle.

However, the swinging range is set to a range beyond the position where the abutment roller 17 abuts the photosensitive drum 1. Thus, the abutment roller 17 can abut and be brought into contact with the photosensitive drum 1, whereby the second SD gap is secured.

Due to this swinging construction, it is possible for the four abutment rollers respectively provided at both end portions of the first and second development sleeves to abut the abutted portion in a stable manner. Further, by using the first developer carrying member as the swinging center, it is possible to secure the requisite gap between the blade and the first developer carrying member. The pressurization force applied to the abutment rollers 16 and 17 is 1 to 2 kg per abutment roller.

Figure 4:
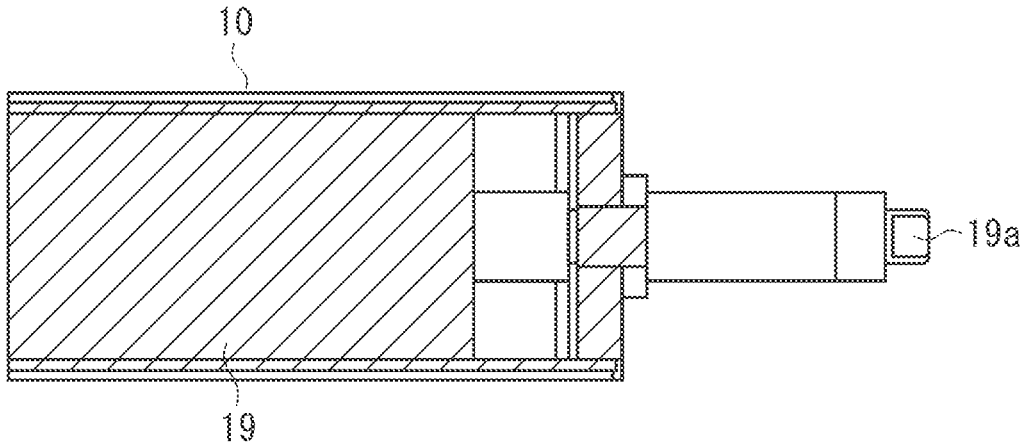
FIG. 4 is a sectional view of a first developing sleeve 10.

FIG. 4 is a sectional view of the first developing sleeve 10. In the following, the internal structure of the first developing sleeve will be described.

Figure 6:
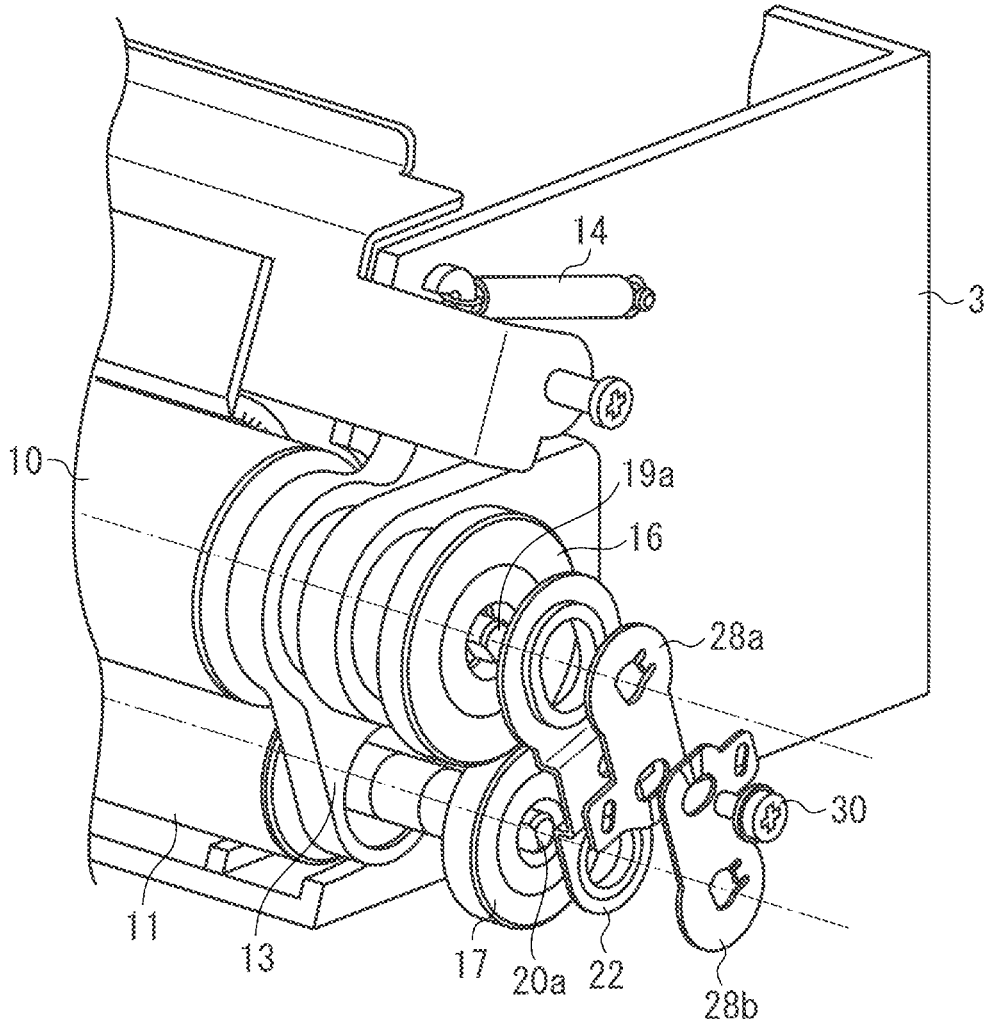
FIG. 6 is a diagram illustrating a construction of an end portion on the opposite side in the longitudinal direction of the developing sleeve with respect to the developing drive unit side.

The first developing sleeve 10 contains a first magnet roll 19 therein. The first magnet roll 19 is of a cylindrical configuration, at the center of which a shaft is fixed. As illustrated in FIG. 6, one end portion of the shaft is of a D-shaped sectional configuration, and this D-shaped portion 19*a* extends through the pipe-like flange of the first developing sleeve 10 to be exposed to the exterior.

The position of the linear portion of this D-shaped configuration and the position of the poles of the magnet roll in the peripheral direction are in a fixed relationship, so that the peripheral arrangement of the magnetic poles of the first magnet roll 19 can be seen from the D-shaped portion 19*a*. Thus, by performing positioning of the D-shaped portion 19*a*, positioning of the magnetic poles in the peripheral direction is performed. This also applies to the second developing sleeve 11.

Figure 5:
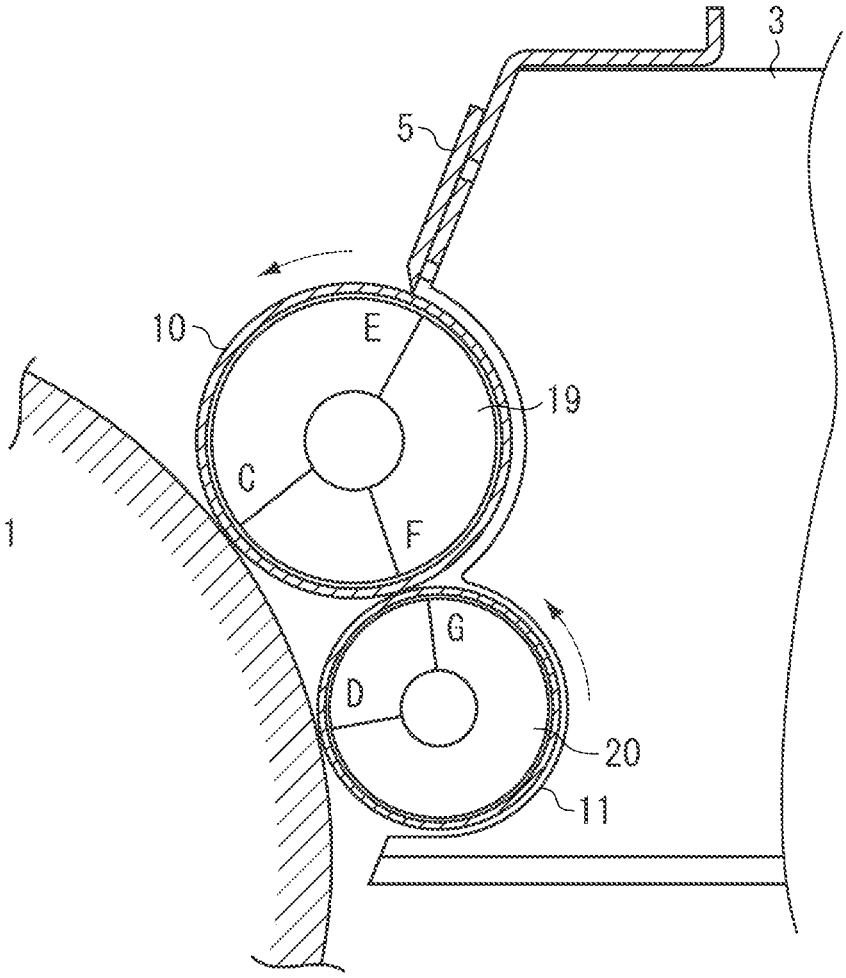
FIG. 5 is a sectional view of the first and second developing sleeves when the developing apparatus is attached to the body of the image forming apparatus.

FIG. 5 is a sectional view of the first and second developing sleeves when the developing apparatus is attached to the image forming apparatus body. In the following, the magnetic pole arrangement in the magnet roll within each developing sleeve will be illustrated in detail.

The first magnet roll 19 and the second magnet roll 20 within the first developing sleeve 19 and the second developing sleeve 11 have a plurality of magnetic poles (C, D, E, F, and G) arranged in the peripheral direction. Apart from carrying magnetic toner, the magnetic poles have their respective roles. In the following the roles of the magnetic poles will be illustrated.

The poles C and D are development poles. They are arranged at positions opposing the photosensitive drum 1 and enhance development property by erecting the magnetic toner in the development regions. The pole E is a cut pole. It is arranged opposing the blade, and by erecting the magnetic toner at the blade portion, it enhances the coating property of the toner on the surface of the first developing sleeve.

The poles F and G are referred to as the SS-poles. They are provided at positions where the first magnet roll 19 and the second magnet roll 20 are opposed to each other. Generally speaking, the SS-poles are of different polarities, thereby enhancing the coating property of the toner on the surface of the second developing sleeve.

The SS-poles are of different polarities since it is desirable in achieving an enhancement in coating property to regulate the magnetic toner on the second developing sleeve with the magnetic toner erecting between the sleeves. Further, to aid the conveyance of magnetic toner, the poles E, C, and F are an N-pole, S-pole, and N-pole, respectively, and the poles G and D are an S-pole, and N-pole, respectively.

The magnetic poles must be set in position in the peripheral direction with high precision. This is because, if the positional relationship between the development poles and the photosensitive drum, and the positional relationship between the cut pole and the blade are deviated from predetermined positional relationships, the erecting configuration of the magnetic toner on the sleeves in the development regions and at the blade portion will be changed.

As described above, in the SS-poles, the magnetic toner on the second developing sleeve is regulated by the magnetic toner on the first developing sleeve. In this connection, regulation is performed by conveying the magnetic toner on both the first developing sleeve and the second developing sleeve while causing the toner to erect between the SS-poles due to these SS-magnetic poles. Thus, as compared with the regulation of the magnetic toner at the blade portion, the regulation thereof at the SS-poles is rather unstable indeed.

Thus, even if it occurs to such a small degree as to be negligible in the case of deviation in the relative positions of the cut pole and the blade and deviation in the relative positions of the development poles, deviation in the relative positions of the SS-poles affects the coating property of the second developing sleeve. In the present exemplary embodiment, a deviation in phase of the SS-poles by approximately 2 to 4 degrees or more resulted in unevenness in coating. However, the above-mentioned range should not be construed restrictively since it is also influenced by the sleeve diameter and the intensity of the magnetic poles.

In the present exemplary embodiment, regarding the cut pole E of the first magnet roll 19, it is set in position 7 degrees upstream the position where it is closest to the blade 5 in the rotating direction of the first developing sleeve. Regarding the SS-pole F, it is set in position 8 degrees downstream the position where the sleeves are closest to each other in the rotating direction of the first developing sleeve.

On the other hand, regarding the SS-pole G, it is set in position 11 degrees upstream the position where the sleeves are closest to each other in the rotating direction of the second developing sleeve.

However, these optimum positions of the magnetic poles are also influenced by the sleeve diameter and the intensity of the magnetic poles, so that they should not be construed restrictively, and proper ranges for them may be set each time as appropriate.

In the following, positioning of these magnetic poles will be described in detail. FIG. 6 is a diagram illustrating the construction of the end portions of the developing sleeves longitudinally on the side opposite to the development drive unit side. Regarding the bearing holder 12, the swinging holder 13, and the abutment rollers 16 and 17, they are of the same construction as those on the development drive side. Therefore, a description thereof will be omitted, and the following description is made by centering on their features.

As illustrated in FIG. 6, on the outer side in the longitudinal direction of the abutment rollers 16 and 17, a conductive connecting member 22 is fit-engaged with the first and second developing sleeve shafts, thereby connecting the first and second developing sleeves to each other. Further, on the outer side thereof, there exist magnetic pole positioning members 28*a* and 28*b*, which are positioning units for setting the magnet rollers 19 and 20 in position.

The connecting member 22 is formed of sheet metal, and has fit-engagement holes to be fit-engaged with the first and second developing sleeve shafts. For a reduction in wear, the fit-engagement holes are formed by forcing copper-type sintered members into the sheet metal.

Further, as illustrated in FIG. 6, in the connecting member 22, the fit-engagement hole to be fit-engaged with the first developing sleeve 10 performs regulation in a direction perpendicular to the line connecting the centers of the first and second sleeves, and is a hole elongated in the direction, whereas the fit-engagement hole to be fit-engaged with the second developing sleeve 11 is a round hole. This difference helps to avoid affecting the precision of the SS-gap maintained by the swinging holder 13.

The magnetic pole positioning members 28*a* and 28*b* are formed of beryllium bronze, and have D-cut holes as illustrated in FIG. 6. The D-cut holes of the magnetic pole positioning members 28*a* and 28*b* are respectively fit-engaged with the D-cut portions 19*a* and 20*a* of the magnet rolls 19 and 20 before fixing them to the connecting member 22 with a screw 30.

By using such positioning units, the first and second magnetic field generating members are set in position in the peripheral direction with respect to the connecting member, whereby the magnetic pole positioning members 28*a* and 28*b* can perform positioning in the peripheral direction of the magnet rolls 19 and 20 with respect to the connecting member 22 without hindering the swinging of the second developing sleeve 11.

Further, in the above supporting method, it is possible to maintain the relative positions of the magnetic poles of the first and second magnet rolls, that is, the phases of the SS-poles, regardless of the swinging angle of the second developing sleeve 11 due to the component precision at the time of mounting to the image forming apparatus body. As a result, it is possible to suppress defective coating on the second developing sleeve.

Even if swinging of the second developing sleeve 11 is caused by chipping of the abutment rollers and chipping of the portion of the connecting member 22 fit-engaged with the first developing sleeve, it is possible to maintain the relative positions of the magnetic poles of the first and second magnet rolls, that is, the phases of the SS-poles.

As described above, in the present exemplary embodiment, the connecting member 22 is a member configured to swing together with the second developing sleeve 11, and to perform positioning in the peripheral direction of the magnet rolls 19 and 20 and to maintain the relative positions of the magnetic poles of the first and second magnet rolls, that is, the phases of the SS-poles, regardless of the swinging angle of the second developing sleeve 11.

On the other hand, the swinging holder 13 is a member configured to swingably support the second developing sleeve 11 while maintaining the SS-gap. Thus, it is also possible, for example, to fasten the magnetic pole positioning members 28*a* and 28*b* to the swinging holder 13 with a screw without using the connecting member 22.

In this case, the swinging holder 13 swings together with the second developing sleeve, and performs positioning in the peripheral direction on the magnet rolls 19 and 20, functioning also to maintain the phases of the SS-poles regardless of the swinging angle of the second developing sleeve 11 like the connecting member 22.

Figure 7:
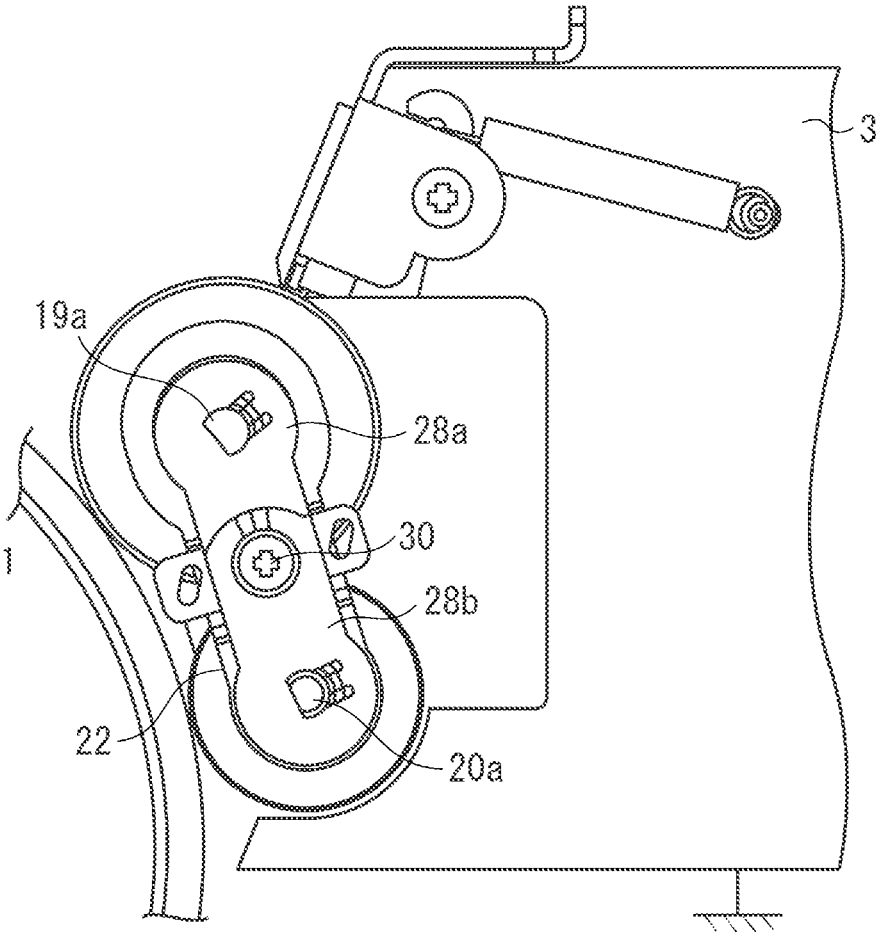
FIG. 7 is a diagram illustrating a construction for performing positioning of the magnetic poles of first and second magnet rolls.

FIG. 7 is a diagram illustrating how positioning is performed on the magnetic poles of the first and second magnet rolls. The adjustment of the magnetic poles will be described below.

The D-cut portions of the first and second magnet rolls are fit-engaged with the D-cut holes of the magnetic pole positioning members 28*a* and 28*b*, and, in this state, the magnetic pole positioning members 28*a* and 28*b* are rotated, thereby performing positioning in the peripheral direction on the development poles C and D, the cut pole E, and the SS-poles F and G of the first and second magnet rolls 19 and 20.

After the magnet rolls are set in predetermined magnetic pole positions, the magnetic pole positioning members 28*a* and 28*b* are both fastened (co-fastened) to the connecting member 22 at the same position.

Through this adjustment of the magnetic poles, it is possible to perform a magnetic pole adjustment with high precision. While, in the present exemplary embodiment, the magnetic pole positioning members 28*a* and 28*b* are co-fastened, this should not be construed restrictively, and it is also possible to fasten them to the connecting member 22 at different positions by using separate screws.

In the following, the position at which the co-fastening of the magnetic pole positioning members 28*a* and 28*b* are performed by using the screw 30 will be described.

FIGS. 8A to 8E are diagrams illustrating force applied to the connecting member according to the co-fastening position. The first and second magnet rolls have magnetic poles at opposing positions, which exert forces in the rotating direction.

The force applied to the connecting member 22 varies depending upon the difference in the co-fastening position of the magnetic pole fastening member. In particular, a force perpendicular to the line connecting the centers of the first and second developing sleeves causes chipping in this perpendicular direction of the fit-engagement portions of the connecting member 22, and, as a result, causes deviation in the relative positions of the first and second magnet rolls and the developing container 3. Thus, the force must be made as small as possible.

This is because, deviation in the relative positions of the first and second magnet rolls and the developing container 3 will cause deviation in the relative positions of the development pole and the photosensitive drum and in the relative positions of the cut pole and the blade.

In FIGS. 8A to 8E, the solid-line arrow indicates a force applied to the connecting member 22 from the magnetic pole positioning member 28*a*, the dashed-line arrow indicates a force applied to the connecting member 22 from the second magnetic pole positioning member 28*b*, and the triple-line arrow indicates a resultant force applied to the connecting member 22 from the magnetic pole positioning members 28*a* and 28*b*. In the construction according to the present exemplary embodiment, of the fit-engagement holes of the connecting member 22, the fit-engagement hole fit-engaged with the first developing sleeve 10 is an elongated round hole, and the one fit-engaged with the second developing sleeve 11 is a round hole.

Figure 8A:
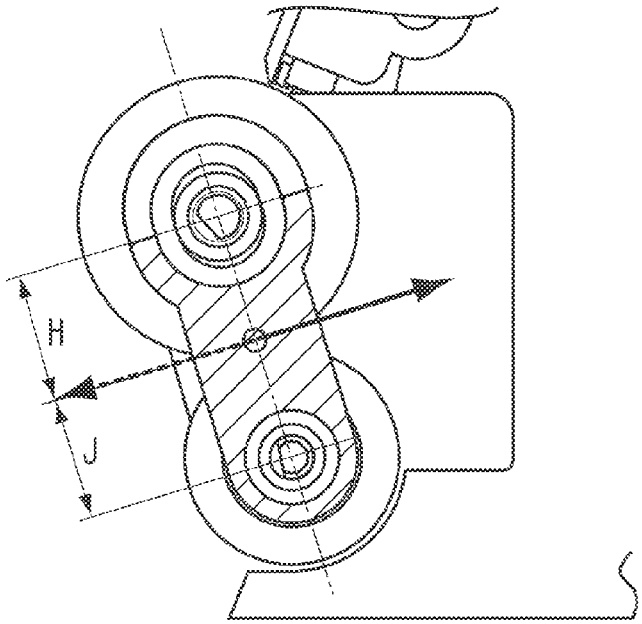
FIGS. 8A to 8E are diagrams illustrating a force applied to a connecting member according to a co-fastening position.

In FIG. 8A, the segments H and J (connecting the centers of the developing sleeves) are equal to each other, and the co-fastening is performed in the line connecting the centers of the first and second developing sleeves 10 and 11. In this case, the force applied from the magnetic pole positioning member 28*a* and the force applied from the magnetic pole positioning member 28*b* are of the same magnitude and in opposite directions, so that the force applied to the connecting member 22 is 0. Thus, this is the optimum position for the co-fastening.

Figure 8B:
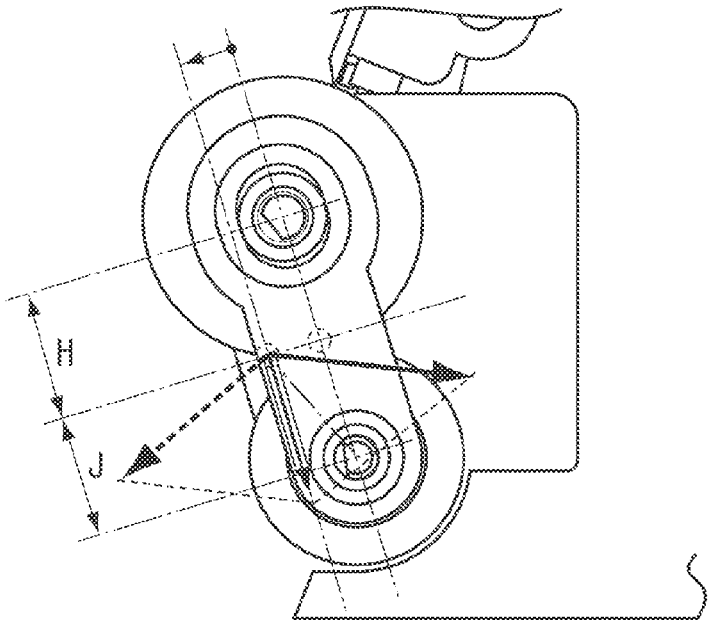

In FIG. 8B, H=J, and the fastening is performed on the drum side of the line connecting the centers of the first and second developing sleeves 10 and 11. As illustrated in FIG. 8B, in this case, the resultant force is directed downward, and the component of the resultant force in the direction perpendicular to the line connecting the centers of the first and second developing sleeves is 0.

Figure 8C:
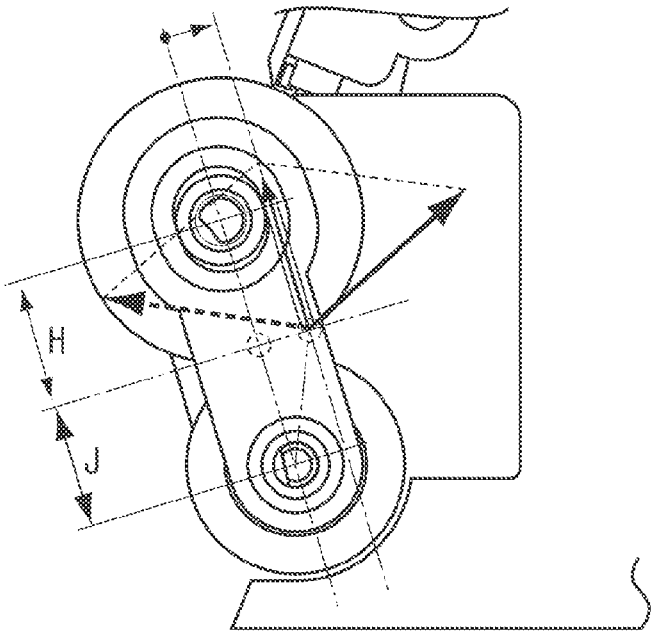

In FIG. 8C, H=J, and the fastening is performed on the developing container side of the line connecting the centers of the first and second developing sleeves 10 and 11. As illustrated in the FIG. 8C, the resultant force is directed upwards, and the component of the resultant force in the direction perpendicular to the line connecting the centers of the first and second developing sleeves is 0. Thus, in the case of FIGS. 8B and 8C, no chipping of the fit-engagement portions of the connecting member 22 with passage of time occurs in the direction perpendicular to the line connecting the centers of the first and second developing sleeves, so that there is no fear of the swinging of the connecting member 22.

Figure 8D:
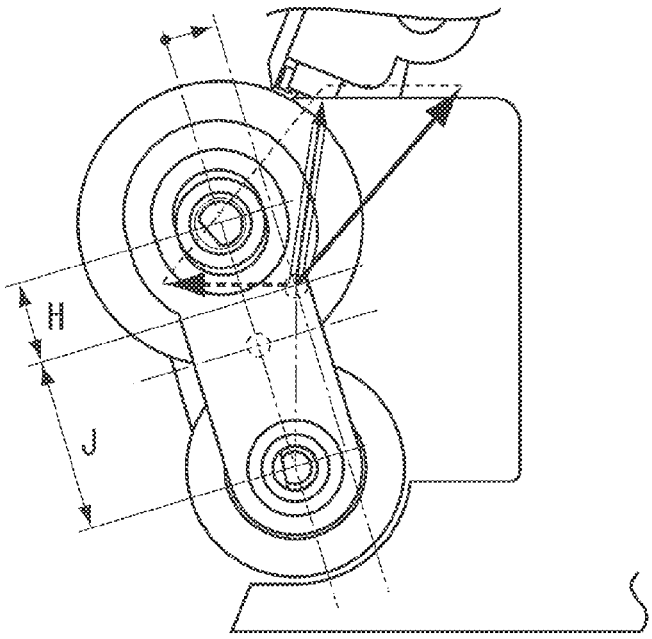
Figure 8E:
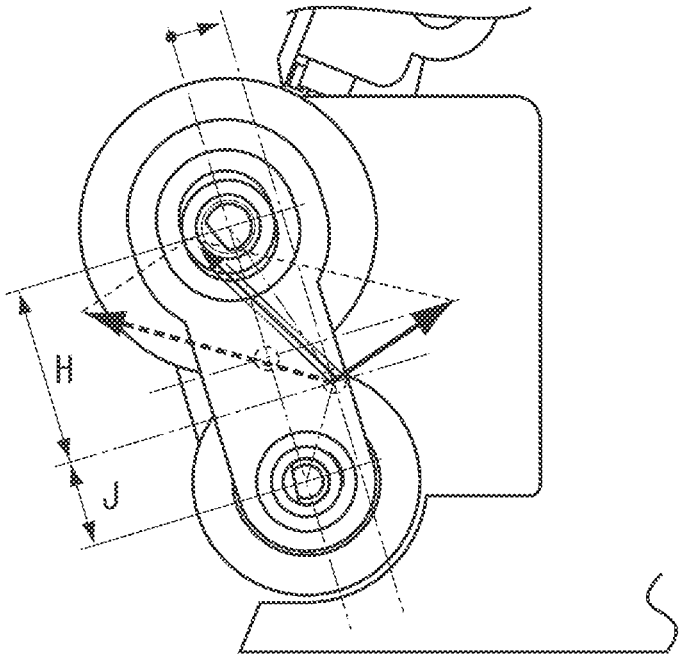

Unlike the case of FIG. 8C, in the cases of FIGS. 8D and 8E, H<J, and H>J, respectively. In both cases, there appears a component of the resultant force in the direction perpendicular to the line connecting the centers of the first and second developing sleeves, and there occurs chipping with passage of time of the fit-engagement portions of the connecting member 22 in this perpendicular direction.

However, as compared with the case in which positioning with respect to the connecting member 22 is solely performed on the second magnet roll, the component of the resultant force in the direction perpendicular to the line connecting the centers of the first and second sleeves is smaller, so that the chipping of the connecting member 22 in this perpendicular direction is mitigated.

Thus, the fastening position of the magnetic pole positioning member is determined as follows. The position is on the connecting member, and it is within the region (the shaded region in FIG. 8A), which is between the line passing the center of the first developing sleeve and perpendicular to the line connecting the centers of the first and second developing sleeves and the line passing the center of the second developing sleeve and perpendicular to the line connecting the centers of the first and second developing sleeves. Through the fastening at such a position, it is possible to reduce the component of the resultant force acting on the connecting member 22 perpendicular to the line connecting the centers of the first and second developing sleeves and to mitigate chipping of the connecting member 22 in this perpendicular direction.

While, in the example described above, the diameters of the first and second magnet rolls are equal to each other, it is possible to mitigate the chipping of the above-mentioned perpendicular direction even if the diameters are different. The diameters of the first and second magnet rolls are different, and the resultant force of the connecting member 22 is 0 when the co-fastening is performed at a position where H:J=first magnet roll diameter : second magnet roll diameter, and which is on the line connecting the centers of the developing sleeves 10 and 11.

While, in the present exemplary embodiment, the positioning of the magnetic poles is performed with respect to the connecting member 22, this should not be construed restrictively, and it is also possible to perform the positioning of the magnetic poles with respect to the swinging holder 13. In this case, the swinging holder 13 swingably supports the second developing sleeve 10, and also carries out the function of the connecting member 22, i.e., maintains the relative positions of the first and second magnet rolls, that is, the phases of the SS-poles.

Further, while, in the present exemplary embodiment, two positioning members are co-fastened to the connecting member 22, this should not be construed restrictively, and it is also possible to fasten the positioning members separately to the swinging holder connecting member 22. Further, it is also possible to perform positioning by using only one positioning member.

Further, while, in the present exemplary embodiment, the developing sleeve vertically on the lower side is swingable, it is also possible for the developing sleeve vertically on the upper side to be swingable. In this case, it is desirable for the developing sleeve vertically on the lower side to undergo regulation of the magnetic toner it carries and conveys by the blade, with the developing sleeve vertically on the upper side undergoing regulation of the magnetic toner it carries and conveys by the lower developing sleeve.

This is because, if the blade is provided vertically on the upper side, the gap between the blade and the upper developing sleeve will be changed each time the upper developing sleeve swings, resulting in a rather unstable toner coating.

Further, while, in the present exemplary embodiment, the rotating directions of the photosensitive drum and of the developing sleeves are the same in the development region, this should not be construed restrictively, and their rotating directions maybe opposite in the development region. Further, the rotating directions of the first and second developing sleeves are not restricted to the same direction but may also be opposite directions.

Further, while, in the present exemplary embodiment, the magnet rolls 19 and 20 are fixed in position through fit-engagement of the D-cut portions, this should not be construed restrictively, and the magnet rolls 19 and 20 may also fixed in position through welding.

Further, while, in the present exemplary embodiment, two developing sleeves are used, this should not be construed restrictively, and the present invention is also applicable to a multi-stage developing apparatus using four developing sleeves.

Further, while, in the present exemplary embodiment, a coil spring serving as an elastic member is used as the pressurization member for urging the developing container 3 toward the photosensitive drum 1, and as the pressurization member for urging the second developing sleeve toward the photosensitive drum 1, this should not be construed restrictively, and in the present invention, it is also possible to select from elastic members such as a plate spring and a torsion coil spring as appropriate. Further, it is also possible to adopt a construction in which urging toward the photosensitive drum is not performed by a pressurization member but by its own weight.

Further, while, in the present exemplary embodiment, abutment rollers are caused to abut the photosensitive drum as a means for maintaining a gap between the photosensitive drum and the developing sleeves, this should not be construed restrictively, and it is also possible to abut a positioning pin to an abutted portion on the frame side.

The positioning of the magnetic poles, which is a feature of the present exemplary embodiment, will be described below. Regarding the basic construction of the developing apparatus, it is similar to that of the first exemplary embodiment, and a description thereof will be omitted.

Figure 9:
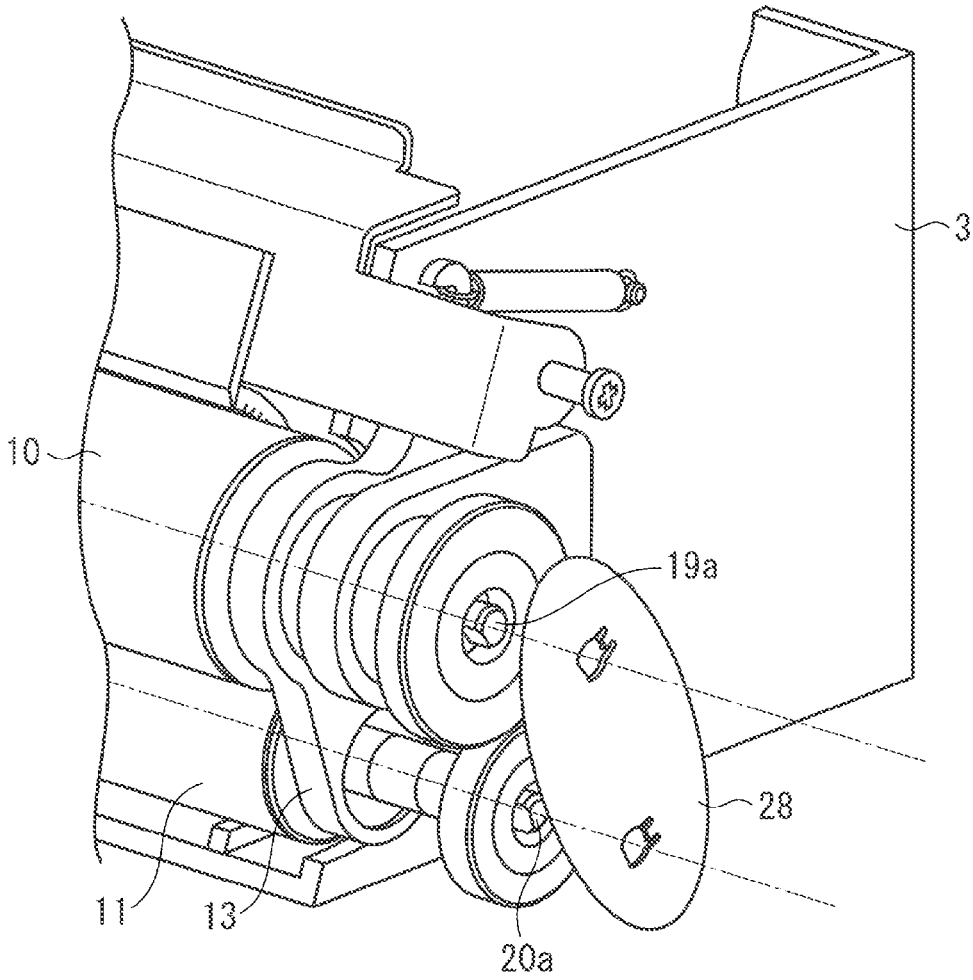
FIG. 9 is a diagram illustrating a construction of a longitudinal end portion of a developing apparatus according to a second exemplary embodiment of the present invention.

FIG. 9 is a diagram illustrating a construction of a longitudinal end portion of a developing apparatus according to the present exemplary embodiment. In the present exemplary embodiment, no connecting member 22 is provided, and the positioning of the magnetic poles is performed by a single magnetic pole positioning member 28.

The magnetic pole positioning member 28 functions both as the connecting member 22 and as the magnetic pole positioning members 28*a* and 28*b* of the first exemplary embodiment. In this construction, the positioning of the magnetic poles can be performed by a single positioning member, resulting in a reduction in the number of components as compared with the first exemplary embodiment.

In the present exemplary embodiment, the magnetic pole positioning member 28 is provided on the outer side in the longitudinal direction of the abutment rollers 16 and 17. As illustrated in FIG. 9, the magnetic pole positioning member 28 has two D-cut holes, and D-cut portions 19*a* and 20*a* at the end of the first and second magnet rolls 19 and 20 are respectively fit-engaged with the two fit-engagement holes of the magnetic hole positioning member 28.

As a result, the first and second magnet rolls 19 and 20 are connected by the magnetic pole positioning member 28, and the magnetic pole positioning member 28 swings as the second developing sleeve swings. In other words, the second developing sleeve is swingable around the first developing sleeve.

Further, the first and second magnet rolls are connected to the same member, i.e., the magnetic pole positioning member 28, and positioning in the peripheral direction is performed thereon, so that even when the second developing sleeve swings, the relative positions of the magnetic poles of the first and second magnet rolls are not changed.

Thus, irrespective of the swinging angle of the second developing sleeve 11 due to the component precision at the time of mounting to the image forming apparatus body, it is possible to maintain the relative positions of the first and second magnet rolls, i.e., the phases of the SS-poles.

Further, solely by fit-engaging the D-cut holes of the magnetic pole positioning member 28 with the D-cut portions 19*a* and 20*a*, the magnetic pole positions in the peripheral direction of the first and second magnet rolls are determined. Thus, when the magnetic pole positions of the magnet rolls, which are determined by the configuration of the D-cut portions, are taken into consideration in determining the configuration of the D-cut holes, the positioning of the magnetic poles can be easily performed.

Instead of providing the swinging holder 13, it is also possible to swingably support the first and second developing sleeves by the magnetic pole positioning member 28. In this case, the magnetic pole positioning member not only performs positioning on the magnetic poles but also serves to swing the second developing sleeve around the first developing sleeve.

According to the present invention, irrespective of variation in the swinging angle of the developer carrying members due to variation in component precision, it is possible to secure the phases of the SS-poles of the magnetic field generating members opposed to each other. As a result, it is possible to suppress image defect such as unevenness in density.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-238688 filed Oct. 25, 2010, which is hereby incorporated by reference herein in its entirety.

What is claimed is:

1. A developing apparatus comprising:

a developing container configured to accommodate a magnetic developer;

a first developer carrying member rotatably fixed to the developing container and configured to carry and convey the magnetic developer;

a second developer carrying member provided so as to be swingable around the first developer carrying member and configured to carry and convey the magnetic developer, which is regulated at a position opposing the first developer carrying member;

a first magnetic field generating member provided inside the first developer carrying member, the first magnetic field generating member having a plurality of magnetic poles including at least a first magnetic pole provided at a position opposing the second developer carrying member;

a second magnetic field generating member provided inside the second developer carrying member, the second magnetic field generating member having a plurality of magnetic poles including at least a second magnetic pole of a different polarity from that of the first magnetic pole at a position opposing the first magnetic pole;

a connecting member connecting the first and second developer carrying members and configured to swing together with the second developer carrying member;

an urging member configured to urge the second developer carrying member toward an image bearing member;

a first positioning member configured to regulate rotation of the first magnetic field generating member and perform positioning of the first magnetic field generating member in a peripheral direction thereof; and a second positioning member configured to regulate rotation of the second magnetic field generating member and perform positioning of the second magnetic field generating member in a peripheral direction thereof, wherein both of the first positioning member and the second positioning member are connected to the connecting member.

2. The developing apparatus according to claim 1, wherein the first positioning member and the second positioning member are fastened to the connecting member in an area between a first straight line which is perpendicular to a line connecting centers of the first and second developer carrying members and passes through the center of the first developer carrying member and a second straight line which is perpendicular to the line connecting the centers of the first and second developer carrying members and passes through the center of the second developer carrying member.

3. The developing apparatus according to claim 1, further comprising a blade configured to regulate the magnetic developer on the first developer carrying member, wherein the first developer carrying member is positioned on an upstream side than the second developer carrying member with respect to a rotating direction of the image bearing member.

4. The developing apparatus according to claim 1, wherein the connecting member has fit-engagement holes respectively fit-engaged with the first and second developer carrying members, wherein one fit-engagement hole is an elongated hole configured to perform regulation in a direction perpendicular to a line connecting the centers of the first and second developer carrying members, which is elongated in a direction of the line, and wherein the other fit-engagement hole is a round hole.

* * * * *